US006015009A

United States Patent [19]

Allen

[11] Patent Number: 6,015,009

[45] Date of Patent: Jan. 18, 2000

[54] CASING AND TUBING HANGER SYSTEM

[75] Inventor: Jack R. Allen, Milam, Tex.

[73] Assignee: ERC Industries, Houston, Tex.

[21] Appl. No.: 09/027,972

[22] Filed: Feb. 23, 1998

[51] Int. Cl.[7] ..... E21B 33/04

[52] U.S. Cl. ..... 166/89.3; 166/88.2; 166/88.3

[58] Field of Search ..... 166/85.1, 85.5, 166/86.1, 88.1, 89.1, 89.2, 89.3, 88.2, 88.3, 88.4, 75.14

[56] References Cited

U.S. PATENT DOCUMENTS

| | | | |
|---|---|---|---|
| 3,028,917 | 4/1962 | Rhodes | 166/75 |
| 3,050,120 | 8/1962 | McSpadden | 166/88.2 |
| 3,394,761 | 7/1968 | Jackson, Jr. et al. | 166/89.2 |
| 3,603,401 | 9/1971 | Nelson et al. | 166/313 |
| 4,154,302 | 5/1979 | Cugini | 166/315 |
| 4,284,142 | 8/1981 | Kirkland | 166/344 |
| 4,289,199 | 9/1981 | McGee | 166/65 R |
| 4,600,054 | 7/1986 | Miller et al. | 166/75.1 |
| 4,651,831 | 3/1987 | Baugh | 166/344 |
| 4,804,045 | 2/1989 | Reed | 166/65.1 |
| 5,462,119 | 10/1995 | De Souza et al. | 166/348 |
| 5,560,435 | 10/1996 | Sharp | 175/5 |
| 5,706,893 | 1/1998 | Morgan | 166/88.4 |
| 5,794,693 | 8/1998 | Wright et al. | 166/75.14 |

*Primary Examiner*—William Neuder
*Attorney, Agent, or Firm*—Head, Johnson & Kachigian

[57] ABSTRACT

A hanger system for supporting production casing and coiled tubing in a surface pipe has a casing head supported on the surface pipe and has a vertical opening therethrough with an internal circumferential load shoulder. A casing hanger is supported within the casing head vertical opening on the load shoulder, and has a vertical casing opening, the upper portion of which has a conically shaped surface, and exteriorly of the casing opening, a tubing opening. A tubing support plate is received in the casing head vertical opening and has a vertical casing opening dimensioned to receive casing therethrough and, exteriorly of the casing opening, a vertical tubing opening dimensioned to receive tubing therethrough, the upper portion of the tubing opening having a conically shaped surface. Segmented casing slips are positioned in the casing hanger conically shaped surface are configured to engage and support casing. Segmented tubing slips are positioned in the tubing support plate tubing opening conically shaped surface to engage and support tubing. A packoff flange has a vertical casing opening dimensioned to receive casing therethrough and has a recess to receive the upper end of the tubing and a passageway that provides communication between the exterior of the hanger system and the upper end of tubing supported by the tubing support plate.

3 Claims, 4 Drawing Sheets

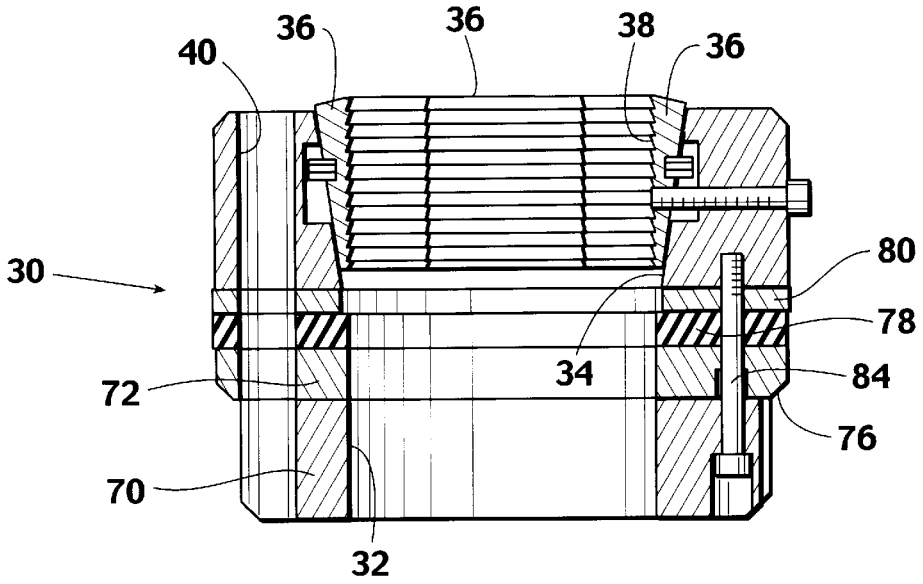
*Fig. 4*
*Fig. 5*
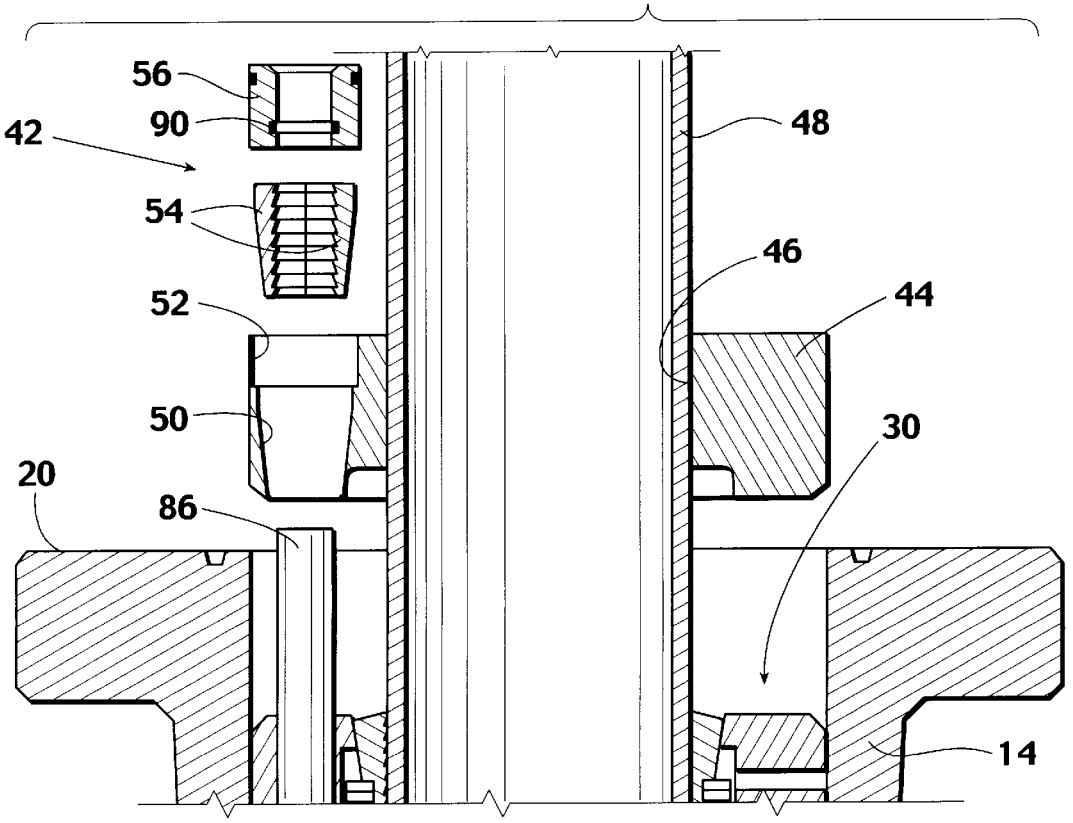

CASING AND TUBING HANGER SYSTEM

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

When drilling an oil or gas well the normal procedure is to drill a large diameter borehole for a relatively short depth of not more than a maximum of several hundred feet. A length of relatively large diameter surface pipe is positioned in this vertical hole and cement is forced into the pipe to flow upwardly in the annular area exterior of the pipe to anchor it solidly in the earth. Thereafter, the borehole is drilled down through the surface pipe to a total depth sufficient to penetrate a producing formation which typically is more than a thousand feet and can extend up to more than two miles in total depth. To produce a well it is necessary to install casing and sometimes, in addition to casing, tubing within the well, the casing and tubing extending the full depth of the borehole from the earth's surface down to the producing formation. Tubing and casing in a borehole must be supported. That is, tubing and casing must be secured at it's upper end to hang within the borehole. Neither tubing or casing are ever inserted in a borehole and allowed to rest on their lower ends. For this reason, it has historically been a practice by those who are expert in drilling and completing oil and gas wells to hang or suspend tubing and casing strings within a borehole. More particularly, the standard practice is to hang or suspend casing and tubing strings from well head equipment fixed to the upper end of a surface pipe that has been anchored in the earth.

Accordingly, sophisticated well head equipment has been devised over the years of the petroleum industry for suspending casing or tubing within a borehole. In recent years, increased emphasis has been placed upon sophisticated drilling and production procedures that sometimes require suspending more than a single string of casing or a single string of tubing in a well borehole. As an example, in some drilling procedures it is highly desirable that an ancillary, usually reduced diameter string of tubing be run exterior of an and parallel with a casing string. The ancillary tubing string can typically be of much smaller diameter than the casing.

A technique which has been developed of running the smaller diameter tubing in a borehole that is in a coil. Whereas casing and tubing are typically run into a well by threading end to end straight lengths of casing or tubing when a relatively small diameter supplementary tubing is required it can be in the form of a long length of tubing that is coiled and that is uncoiled as the small diameter tubing is inserted into a well and, when removed from the well, is received and stored in the form of a coil.

The utilization of one or more supplementary small diameter tubing strings in conjunction with a centrally supported casing has introduced new and sophisticated requirements to well head systems. The invention disclosed here is an improved casing and coil tubing hanger system that facilitates the installation of one or more small diameter strings of tubing in conjunction with a centrally positioned casing suspended from a wellhead.

For background information on tubing hanging methods and apparatus reference may be had to the following previously issued United States Patents which are by reference.

| U.S Pat. No. | INVENTOR | TITLE |
|---|---|---|
| 3028917 | Rhodes | Well Completion Apparatus |
| 3603401 | Nelson et al | Tubing Hanger Method and Apparatus |
| 4154302 | Cugini | Cable Feed-Through Method and Apparatus For Well Head Constructions |
| 42841 42 | Kirkland | Method and Apparatus For Remote Installation and Servicing Of Underwater Well Apparatus |
| 4289199 | McGee | Wellhead Sidewall Electrical Penetrator |
| 4600054 | Miller et al | Tubing Hanger Assembly |
| 4651 831 | Bangh | Subsea Tubing Hanger With Muitiple Vertical Bores And Concentric Seals |
| 4804045 | Reed | Oil and Gas Wells Diversionary Spool Assembly |
| 5462119 | de Souza et al | Tubing Hanging Set For A Submarine Oil-Well, Running Tool For Its Placing and Handling Method |
| 5560435 | Sharp | Method and Apparatus For Drilling Multiple Offshore Wells From Within A Single Conductor String |

BRIEF SUMMARY OF THE INVENTION

The casing and coil tubing hanger system of this invention includes: a casing head supported at the upper end of surface pipe; a casing hanger assembly configured to receive and support a centrally positioned casing within the surface pipe; a tubing hanger that receives and supports at least one tubing string exterior of the casing; and a packoff flange received on the upper end of the casing head for sealably receiving casing extending upwardly therethrough and for sealably securing the upper end of at least one length of smaller diameter tubing, the packoff flange providing communication from the exterior of the flange to the small diameter tubing.

The casing head has a lower tubular portion that telescopically engages an upper end of a surface pipe and has a vertical opening therethrough and within the opening an internal circumferential load shoulder.

A casing hanger assembly is received within the casing head vertical opening and has an external increased diameter portion providing a circumferential load shoulder that seats against the casing head internal load shoulder by which the casing hanger is supported. The casing hanger has a vertical opening dimension to receive casing therethrough. An upper portion of the casing opening has a conically shaped surface. Further, the casing hanger assembly has, exteriorly of the casing opening a vertical tubing opening dimension to receive tubing therethrough.

A tubing support plate is dimensioned to be received in the casing head vertical opening and has a casing opening therethrough dimension to receive casing and, exteriorly of the casing opening, a tubing opening dimension to receive tubing therethrough. The tubing support plate casing opening and tubing openings are in alignment with the similar openings in the casing hanger assembly. The upper portion of the tubing support plate tubing opening is of conical configuration.

Segmented casing slips that have a conical external surface are removable received in the casing hanger casing opening conically shaped portion. The segmented slips have a central opening therethrough defined by circumferential serrated surfaces configured to engage and support casing positioned in the casing hanger casing opening.

Segmented tubing slips have a conical external surface are received in the tubing support plate tubing opening conically shaped surface and have a central opening therethrough defined by circumferential serrated surfaces configured to engage and support tubing positioned within the tubing support plate tubing opening.

A packoff flange has a vertical casing opening dimensioned to sealably receive casing therethrough and has a recessed configured to sealably receive the upper end of tubing. The packoff flange is sealably attached to the upper end of the casing head and provides for retention of the casing hanger assembly and the tubing support plate within the casing head. Further, the packoff flange has a passageway providing closed communication with the upper end of tubing supported by the tubing support plate.

In a preferred embodiment of the invention the casing hanger assembly includes a lower support plate that has a circumferential load shoulder configured to rest on the circumferential load shoulder formed within the interior surface of the casing hanger. An intermediate elastomeric member is positioned on the support plate. An upper casing head body portion is then positioned on top of the elastomeric member. The support plate, elastomeric member and casing head body are secured in an assembly held by a plurality of bolts arranged to permit the casing head body to be displaced downwardly with respect to the support plate to compress the elastomeric when the weight of the casing is supported by the casing head body. The support plate, elastomeric member and casing head body have aligned vertical casing and tubing openings therethrough.

A better understanding of the invention will be obtained from the following description of the preferred embodiment of the invention taking in conjunction with the attached drawings.

DESCRIPTION OF THE DRAWINGS

FIG. 4 is an elevational cross sectional view of a casing hanger with provisions for receiving tubing as employed in the well head system.

FIG. 5 is an elevational exploded view of an upper portion of the casing head with the casing hanger assembly positioned therein and showing the way in which the tubing hanger assembly is positioned with respect to a centrally located casing and a length of smaller diameter tubing in the process of installing the tubing hanger assembly into the casing head.

DETAILED DESCRIPTION OF THE PREFERRED EMBODIMENT

Figure 1:
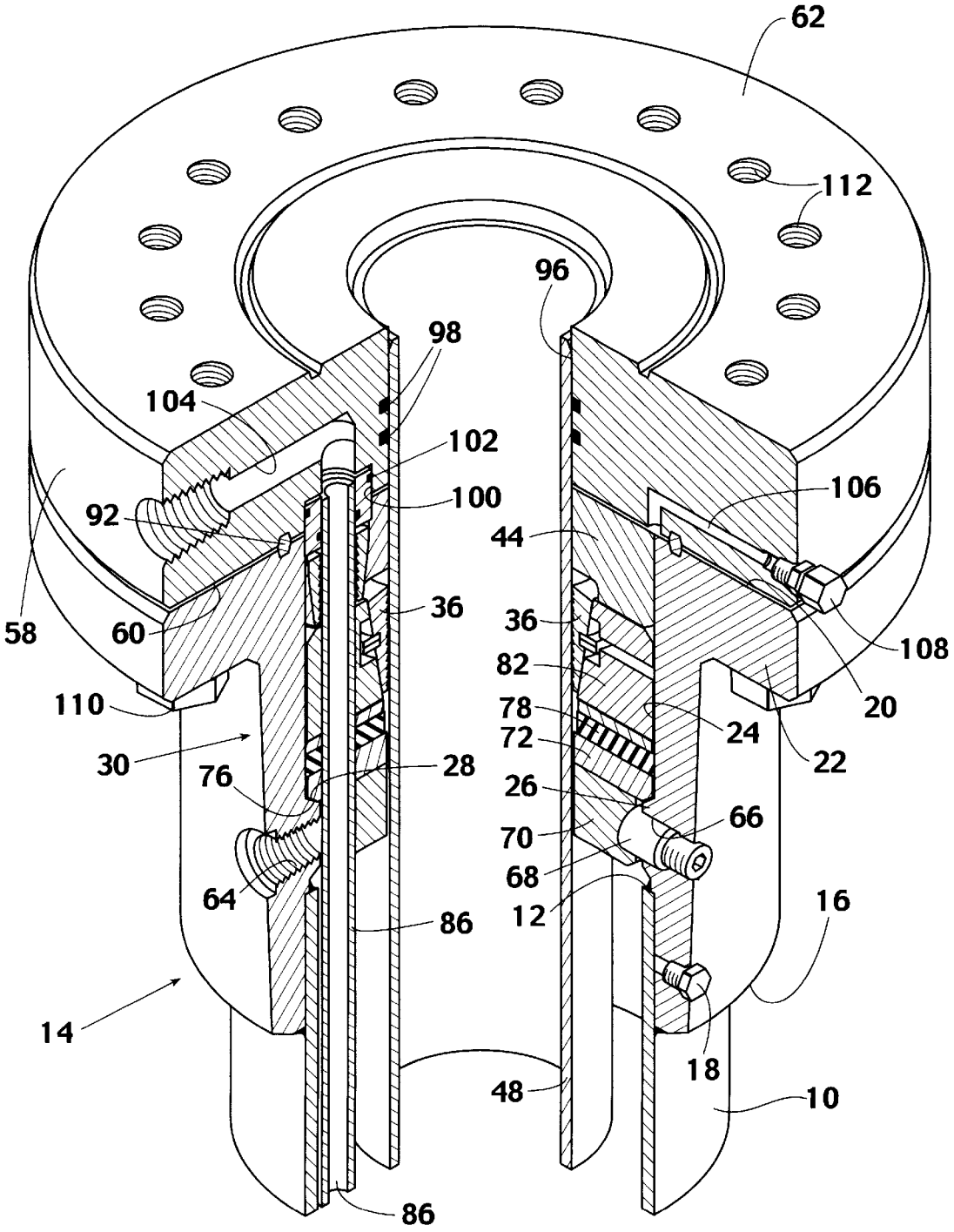
FIG. 1 is an isometric cutaway view of a casing and coiled tubing hanger system of this invention shown supported to the upper end of surface pipe and showing an installed casing and length of smaller diameter tubing supported by the hanger system.

Referring first to FIG. 1 where the basic components making up the casing and tubing hanger system of this invention are illustrated. The upper end portion of surface pipe is indicated by the numeral 10, having an upper end 12. The surface pipe is typically of relatively shorter length than the total borehole and is of sufficient length only such that when securely anchored, such is by cementing, into the earth's surface it will support casing and tubing strings as necessary to complete the drilling of the borehole and for the subsequent production of liquids or gases upwardly through the borehole to the earth's surface. Positioned on the upper end of surface pipe 10 is a casing head 14. The lower end 16 of the casing head is telescopically positioned over the upper end 12 the surface pipe and the casing head is secured to the surface pipe such as by welding or by means of anchor bolt 18, only one of which is shown.

Casing head 14 includes at the upper end 20 thereof an integral radial flange portion 22. Further, the casing head has a central relatively large diameter vertical passageway 24 that includes a reduced internal diameter circumferential portion 26 that provides a circumferential load shoulder 28.

Removably position within opening 24 in casing head 14 is a casing hanger assembly generally indicated by the numeral 30. The casing hanger assembly is shown in enlarged cross sectional view in FIG. 4. The casing hanger assembly consists of multiple components which together provide a central vertical opening 32 that is dimensioned to receive casing therethrough. The upper portion of opening 32 is tapered, that is, it has a frusto-conical surface 34 that receives a segmented casing slip 36. Casing slip 36 provides an opening 38 therethrough that in defined by circumferential serrated surfaces configured to engage and support casing. Casing slip 36 is made up of a plurality of segments, the function and operation of which will be described in more detail subsequently.

In addition to a central opening 32 casing hanger assembly 30 includes, exteriorly of casing opening 32, a smaller diameter vertical tubing opening 40 that is dimensioned to receive tubing therethrough.

Returning to FIG. 1, the other basic components of the casing and tubing hanger system include a tubing support assembly generally indicated by the numeral 42, the main element of this assembly being a tubing support plate 44, seen in FIG. 5. Tubing support plate 44 has a vertical opening 46 therethrough for receiving casing, casing being indicated by the numeral 48. In addition, exteriorly of opening 46 is a vertical tubing opening 50, the lower portion of which is frusto-conically shaped, the upper portion 52 of the tubing opening 50 being cylindrical. Segmented tubing slips 54 and a tubular seal sub 56 complete the tubing support system and their functions will be described subsequently.

The final basic portion of the casing and tubing hanger system as seen in FIG. 1 is a packoff flange 58 having a lower surface 60 to sealably engage upper end 20 of casing head 14. Further, the packoff flange has a planar upper surface 62 adaptable to engage a blowout preventer assembly or other equipment that is customarily employed in drilling and/or completing and/or producing oil or gas wells, all as well known to practitioners in the drilling industry.

Figure 2:
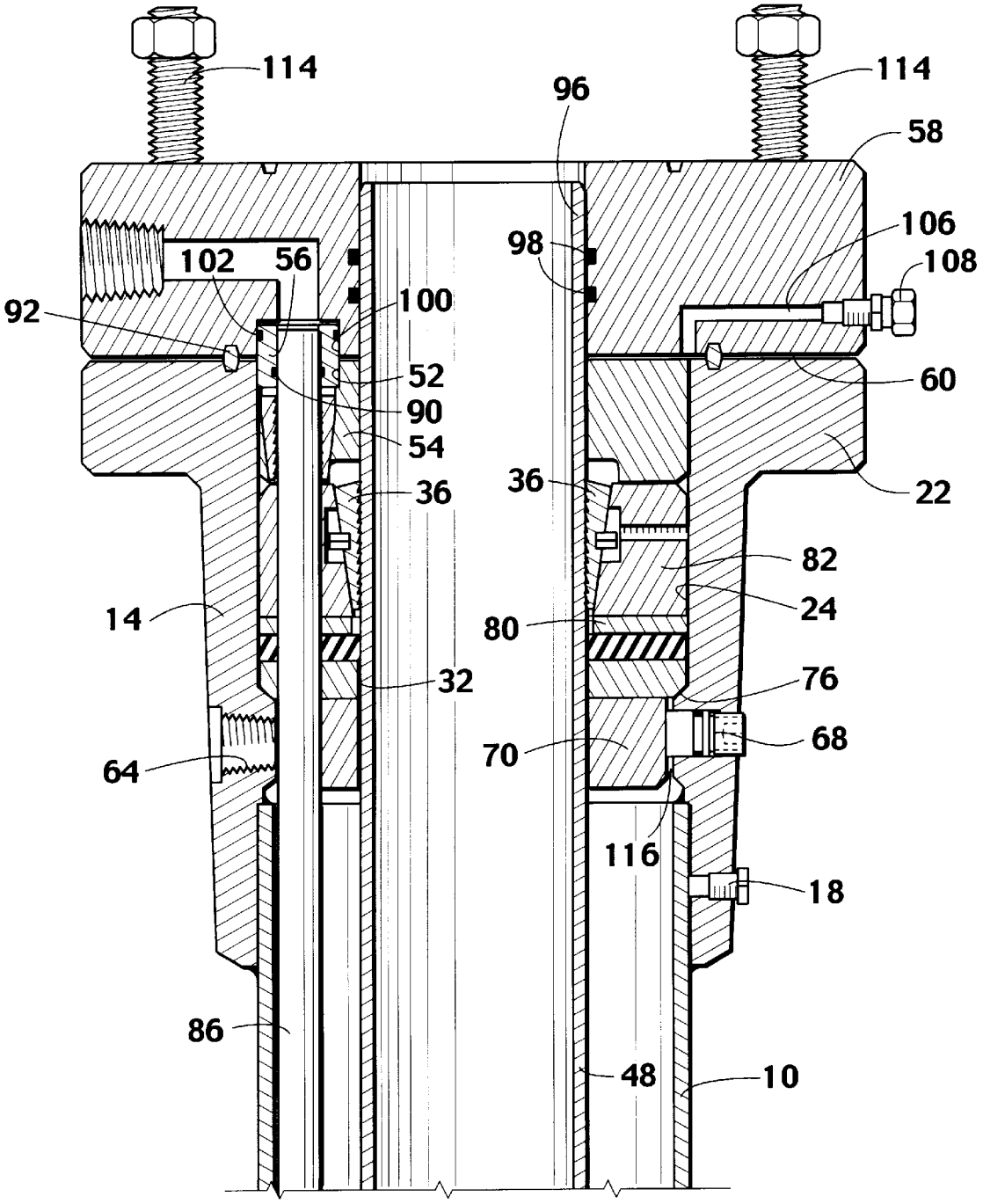
FIG. 2 is an elevational cross section view of the casing and tubing hanger system shown in FIG. 1.

FIGS. 1 and 2 show a threaded opening 64 that provides means of communicating with the interior of surface casing 10 below load shoulder 28. Another threaded opening 66 receives an alignment pin 68 that is used in a method to be described subsequently to ensure proper alignment of the casing hanger assembly when it is inserted into casing head 14.

Referring now to FIG. 4, more details of casing hanger assembly 30 will be described. The casing hanger assembly is made up of a stacked array, beginning with the bottom and building upwardly, of a cylindrical lower plate 70 the main function of which is to provide alignment. On top of lower plate 70 is a support plate 72 that has a circumferential incline surface 76 that rests on circumferential load shoulder 28 formed entirably of casing head 14 (See FIG. 1).

Positioned on top of support plate 72 is an elastomeric disc 78 that is formed of a compressible material such as rubber or plastic. On top of elastomeric disc 78 is a flat cylindrical junk ring 80 and on top of the junk ring is the main portion of the hanger body also known as a slip bowl 82. These five generally flat cylindrical elements, that is lower of plate 70, support plate 72, elastomeric disc 78, junk ring 80 and slip bowl 82 are assembled together and held in vertical orientation by means of a plurality of bolts, one bolt 84 being shown in FIG. 2. At least 2 of such bolts are employed circumferentially around the central opening 32 that is formed in the assembly. Central opening 32 extends through each of the five basic components making up the casing hanger assembly 30. Bolts 84, only one of which is seen, are received in aligned openings through the 5 basic members of the assembly. The opening is threaded only in the slip bowl 82 allowing the slit bowl to move downwardly with respect to the lower components. When the casing hanger assembly 30 is positioned in casing head 42 and a string of casing 48 is supported by the casing head assembly a heavy weight is applied to move slip bowl 82 downwardly with respect to support plate 72. This compresses elastomeric disc 78 to seal against the interior opening 24 in casing head 14.

As was previously described with reference to FIG. 4, the casing hanger assembly 30 has a smaller diameter tubing opening 42 exteriorly of casing opening 32, tubular opening 40 being formed by aligned opening in each of the basic components as has been described.

Figure 3:
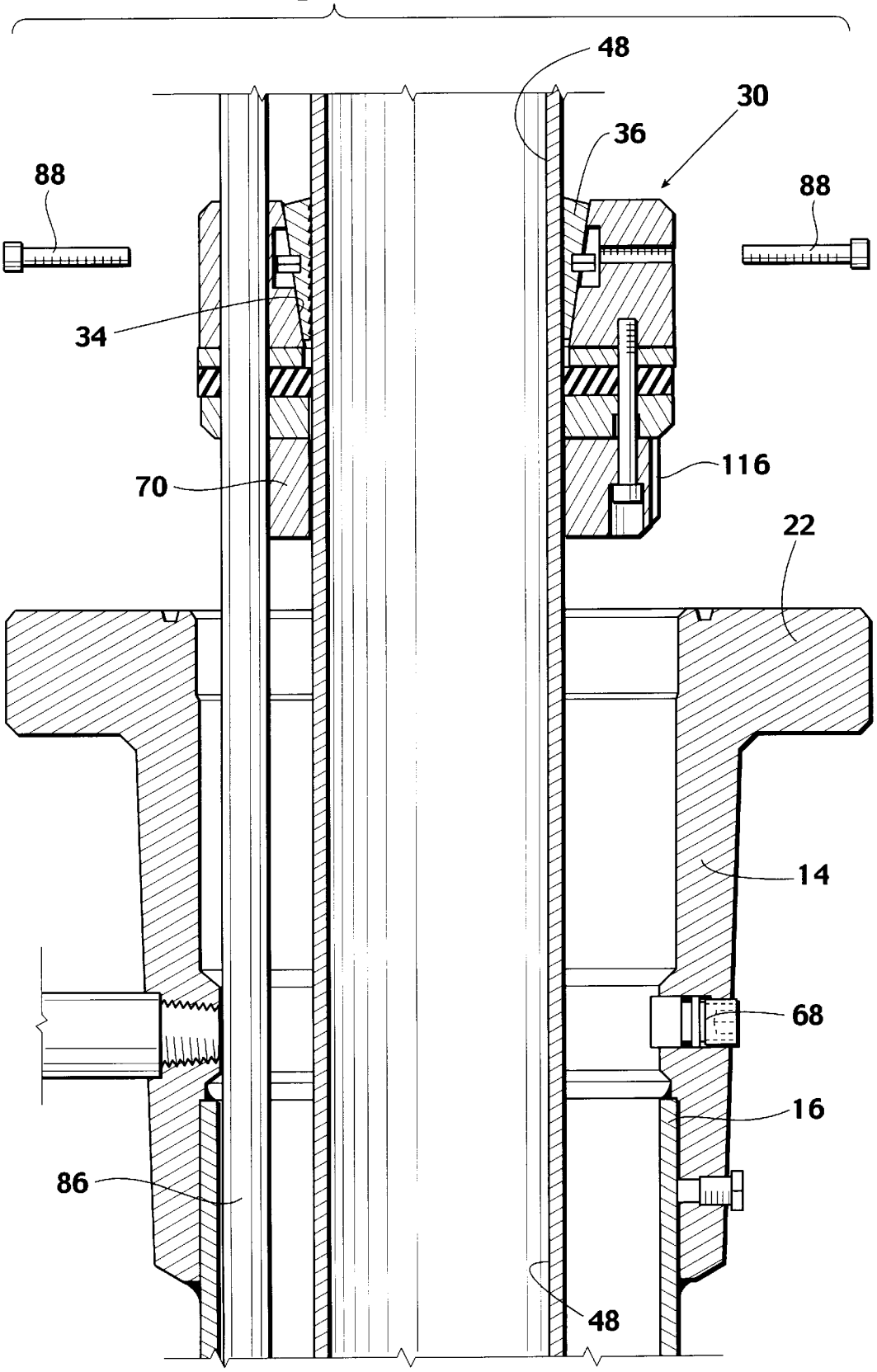
FIG. 3 is an elevational cross sectional exploded view of a step in the assembly of the casing and tubing hanger system of FIGS. 1 and 2 and shows the method by which the casing hanger assembly is positioned exteriorly of a length of casing and a length of tubing as the casing hanger is being positioned within the interior of the casing head.

The system by which the casing hanger assembly 30 is employed to support a length of casing 48 is illustrated in FIG. 3. With casing 48 in position in casing head 14 casing hanger assembly 30 is slid down over the exterior of the casing. To permit the casing hanger assembly 30 to be readily elevationally positioned on casing 48 segmented slips 36 are temporarily held in upward positions by means of slip retention screws 88. As seen in FIG. 3 casing hanger assembly 30 is in position ready to be moved within the interior of casing head 14 so that the retention screws 88 are withdrawn allowing the slips to fall downwardly by gravity to engage the exterior surface of casing 48. Because of the conically relationship between segmented slips 36 and frusto-conical surface 34 in the casing hanger assembly the slips will slide upwardly as required in order to allow downward movement of casing hanger assembly 30 with respect to casing 48, but once in a fixed position within casing head 14 any tendency of downward movement of casing 48 causes the serrated surfaces of slips 36 to engage the external sidewall of the casing 48 to thereby grip the casing and hold it suspended within the borehole.

After the casing head assembly 30 is positioned within casing head 14, as seen in FIG. 5, the tubing support assembly 42 can be positioned within the casing head. Tubing support plate 44 slips down over casing 48. With tubing support plate 44 in position, segmented tubing slips 54 are positioned within the support plates surrounding tubing 86. The tubing 86 is then off cut so that the upper end of the tubing extends a short distance above casing head upper end 20. Thereafter seal sub 56 is positioned within the upper cylindrical portion 52 of the tubing opening through tubing support plate 44. Seal sub 56 has an internal seal 90 that seals against the exterior of tubing 86.

The final step in the assembly of the casing and tubing hanger system is that of positioning onto casing head 14 packoff flange 58. As seen in FIGS. 1 and 2 a circumferential seal 92 is received within aligned grooves in the casing head upper surface 20 and lower surface 60 a packoff flange 58.

A central passageway 96 in packoff flange 58 slidably receives the upper end portion of casing 48. By means of circumferential seals 98 the exterior of casing 48 is sealed to packoff flange 58.

The packoff flange has a cylindrical recess 100 extending upwardly from packoff flange lower surface 60, opening 90 being in alignment and equally dimensioned with the 20 cylindrical portion 52 of the tubular opening through tubing support plate 44, the recess 100 telescopically receiving the upper end portion of seal sub 56. By means of an external seal 102 the exterior of the seal sub is sealed to packoff flange 58.

The packoff flange has a radial passageway 104, the end of which is provided with internal threads, the radio passageway communicating with the interior of tubing 86. Thus threaded opening 104 provides a means for injecting liquids and/or gases downwardly through tubing 86 during the drilling of a borehole or in conjunction with producing liquids and/or gases in a completed well.

A second radial passageway 106 is threaded at its outer end and is shown as being closed with a threaded plug 108. Passageway 106 communicates with the interface between the upper end 20 of casing head 14 and lower surface 60 of packoff flange 58 and serves to provide means of detecting leakage that may be occurring in the system.

Packoff flange 58 is secured to the upper flange portion 22 of casing head 14 by means of bolts 110, only the heads of which are seen in FIG. 1. The upper surface 62 of packoff flange 58 is provided with threaded openings 112 which may receive threaded studs 114 as shown in FIG. 2 as a means of attachment of ancillary equipment to the upper end of the casing and tubing hanger system, such as for attachment of a blow out preventer system.

The system thus provides a unique and effective means of supporting a central casing to a casing hanger system and simultaneously supporting smaller diameter ancillary tubing that can be employed to communicate with the interior of the borehole. While only one tubing 86 is shown it can be seen that the system of this invention may be employed to mount a plurality of tubing strings.

It is important that casing hanger assembly 30 be properly aligned when positioned within casing head 14 so that tubing 18 is properly positioned to receive packoff flange 58. Accordingly, lower plate 70 that is a part of casing hanger assembly 30 functions also as an alignment ring. This is achieved by providing a longitudinal groove 116 (See FIGS. 2 and 3) in the exterior cylindrical surface of lower plate 70. Prior to insertion of casing hanger assembly 30 alignment pin 68 is threadably inwardly advanced so that the inner end thereof interferes with the downward seating of casing hanger assembly 30 unless groove 116 is aligned with the alignment pin. Once the casing hanger assembly is properly aligned within casing head 14 alignment of tubing support plate 44 is automatic since it must be inserted in a way so that the tubing opening 50 therein receives tubing 86.

The system as described and illustrated herein provides an improved slip-type casing hanger that can also suspend one or more strings of tubing, which may preferably be coiled tubing. In the usual practice of the invention the casing and tubing hanger system will be made with multiple sets of slips for different size small diameter coil tubing. The casing and tubing hanger system provides the capability of suspending multiple strings of smaller diameter tubing in addition to a standard casing string with the capability to positively align the location of the tubing strings and allows multiple tubing strings to be suspended by the casing hanger itself without using special adapters or parts that are above the casing head.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A hanger system for supporting casing and tubing in a surface pipe anchored in the earth, the surface pipe having an open upper end, the hanger system comprising:

a casing head having a lower tubular portion that telescopically engages an upper end of the surface pipe, the casing head having a vertical opening therethrough and a decreased internal diameter portion providing an internal circumferential load shoulder;

a casing hanger assembly receivable within said casing head vertical opening and having a circumferential load shoulder that seats against said casing head internal load shoulder by which the casing hanger is removably supported within said casing head, the casing hanger having a vertical casing opening dimensioned to receive casing therethrough, an upper portion of the casing opening having a conically shaped surface and having, exteriorly of the casing opening a vertical tubing opening dimensioned to receive tubing therethrough;

a tubing support plate externally dimensioned to be received in said casing head vertical opening and having a vertical casing opening dimensioned to receive casing therethrough and, exteriorly of the casing opening, a vertical tubing opening dimensioned to receive tubing therethrough, the tubing support plate casing opening and tubing opening being in alignment with said casing and tubing openings in said casing hanger assembly, an upper portion of the tubing support plate tubing opening having a conically shaped surface;

segmented casing slips having a conical external surface removably received in said casing hanger casing opening conically shaped surface and having a central opening therethrough defined by circumferential serrated surfaces configured to engage and support casing positioned in said casing hanger casing opening;

segmented tubing slips having a conical external surface removable received in said tubing support plate conically shaped surface and having a central opening therethrough defined by circumferential serrated surfaces configured to engage and support tubing positioned in said tubing support plate tubing opening; and a packoff flange having a vertical casing opening dimensioned to sealably receive casing therethrough and having a recess configured to sealable receive the upper end of the tubing and being sealably attachable to said casing head providing for retention of said casing hanger assembly and said tubing support plate within said casing head and having a passageway providing closed communication with the upper end of the tubing supported by said tubing support plate.

2. A hanger system for supporting casing and tubing according to claim 1 wherein said casing hanger assembly includes an elastomeric seal that seals said casing hanger assembly to said casing head vertical opening.

3. A hanger system for supporting casing and tubing according to claim 2 wherein said casing hanger assembly includes:

a lower support plate providing said circumferential load shoulder;

an intermediate elastomeric disc positioned on said support plate;

upper slip bowl positioned on said elastomeric disc, said support plate elastomeric disc and casing head body being in an assembly held by a plurality of bolts arranged to permit said casing head body to be displaced downward with respect to said support plate to compress said elastomeric disc when casing is supported by said casing hanger assembly, said support plate and said elastomeric disc having aligned vertical casing and tubing openings therethrough.

* * * * *